United States Patent [19]

Edmisten

[11] 4,092,924

[45] June 6, 1978

[54] METHOD FOR IDENTIFYING THE LOAD CHARACTERISTICS OF A CENTERFIRE FIREARM CARTRIDGE

[76] Inventor: John H. Edmisten, P.O. Box 201, Boone, N.C. 28607

[21] Appl. No.: 784,578

[22] Filed: Apr. 4, 1977

Related U.S. Application Data

[62] Division of Ser. No. 692,844, Jun. 4, 1976.

[51] Int. Cl.[2] ..... B41F 17/00

[52] U.S. Cl. ..... 101/426; 86/36

[58] Field of Search ..... 101/426, 41, 44; 86/36

[56] References Cited

U.S. PATENT DOCUMENTS

| | | | |
|---|---|---|---|
| 328,750 | 10/1885 | Baxter | 86/37 X |
| 735,047 | 8/1903 | Alsop | 86/36 |
| 1,253,463 | 1/1918 | Brown | 101/4 |

*Primary Examiner*—Clifford D. Crowder

*Attorney, Agent, or Firm*—Bell, Seltzer, Park & Gibson

[57] ABSTRACT

A method for identifying the load characteristics of a centerfire firearm cartridge which has been loaded by a process including insertion of an unstruck primer into a primer pocket in the cartridge head and in which indicia identifying the load characteristics of the cartridge are imprinted onto the unstruck primer. The method is contemplated as being particularly useful with reloaded cartridges which are to be again reloaded subsequent to use.

6 Claims, 6 Drawing Figures

METHOD FOR IDENTIFYING THE LOAD CHARACTERISTICS OF A CENTERFIRE FIREARM CARTRIDGE

This application is a divisional application from copending application Ser. No. 692,844, filed June 4, 1976 and entitled "Method and Apparatus for Identifying the Load Characteristics of a Centerfire Firearm Cartridge".

Sportmen and others knowledgeable in the use of firearms using centerfire cartridges are aware of the desirability of identifying the load characteristics of a cartridge in order to assure that a desired effect is achieved. This need for identifying the load characteristics of a centerfire firearm cartridge extends over a wide range of cartridge types and uses, from the carefully crafted cartridge used by a bench rest shooter seeking extreme accuracy to the shot shell chosen by a hunter seeking a particular game bird. Heretofore, this need has been met, in the instance of factory loaded ammunition, by imprinting of indicia on shot shell cartridge cases and on boxes containing centerfire ammunition. While such approaches may in many instances meet the needs of sportmen and others purchasing and using factory ammunition, the needs of persons using reloaded cartridges are not met.

In connection with the reloading and reuse of centerfire firearm cartridge cases, it has become conventional for persons undertaking reloading to maintain records identifying the load characteristics of cartridges. In some instances, such records are duplicated in diaries or logbooks and on labels attached to boxes containing the reloaded cartridges. As can be appreciated, successive reloading of a particular group of cartridge cases may involve the use of varying load characteristics, introducing the danger of confusion where such marked boxes are employed.

With the foregoing in mind, it is an object of the present invention to facilitate the identification of the load characteristics of centerfire firearm cartridges. In realizing this object of the present invention, indicia identifying the load characteristics of a loaded cartridge are imprinted onto an unstruck primer inserted into a primer pocket in the cartridge case head. Such an indicia applied to a primer is removed from the cartridge case upon any subsequent reloading, thereby precluding confusion of indicia.

Yet a further object of this invention is to imprint onto loaded centerfire firearm cartridge cases indicia coded by color and alphanumeric character so as to identify the load characteristics of the cartridge. In accordance with such imprinting, logbooks, boxes and the like may include an identification of the coded indicia with the load characteristics of a cartridge, permitting a user of the cartridge to recheck the load characteristics immediately prior to insertion of the cartridge into the firearm.

Some of the objects of the invention having been stated, other objects will appear as the description proceeds, when taken in connection with the accompanying drawings, in which FIG. 1 is a perspective view illustrating an apparatus of the present invention in use in practice of the method of the present invention;

While the present invention will be described more fully hereinafter with particular reference to the accompanying drawings, it is to be noted at the outset of this description that the present invention is contemplated as having utility in forms and in accordance with procedures differing from those to be particularly described. Accordingly, it is contemplated that the following description and the referenced illustrations be taken as a general teaching directed broadly to persons skilled in the appropriate arts, and not be taken as being restrictive upon this invention.

Figure 1:
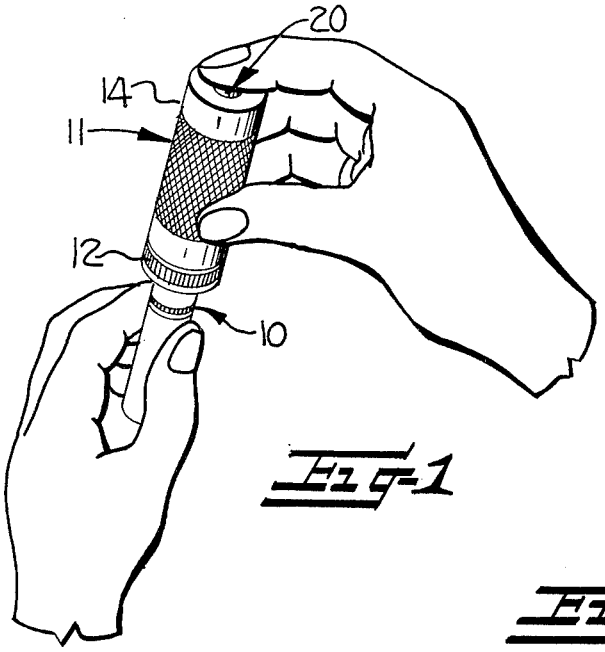
Figure 2:
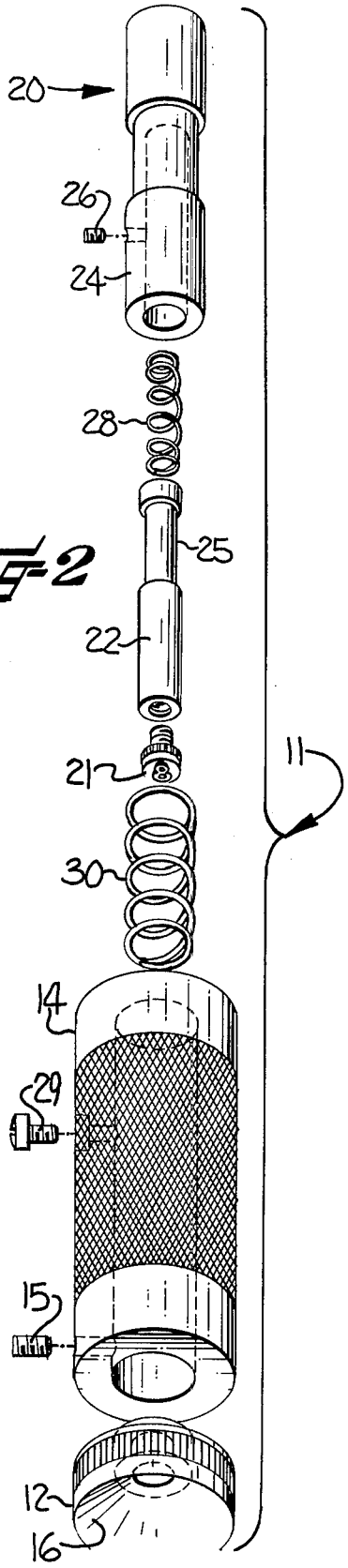
FIG. 2 is an exploded perspective view of the apparatus of FIG. 1.

Referring now more particularly to the accompanying drawings, the apparatus of the present invention imprints onto an unstruck primer of a centerfire firearm cartridge (such as a shotgun shell generally indicated at 10 in FIG. 1) indicia identifying the load characteristics of the cartridge. While a shot shell 10 is generally indicated in FIG. 1, it is contemplated that the apparatus and method of this invention have utility with centerfire firearm cartridges of any and all sizes including particularly pistol and rifle cartridges, and a shot shell cartridge has been chosen only for purposes of convenience in illustrating this invention.

In the use of the apparatus, a head portion of a cartridge 10 is received in a body means generally indicated at 11. In the form illustrated, the body means 11 comprises two portions including a centering means 12 and a manually engageable generally cylindrical member 14. The centering means 12 generally has the form of a plug or button and is secured adjacent one end of the cylindrical member 14 by a set screw 15 or the like.

As illustrated in FIGS. 2–5, the centering means 12 defines an inwardly converging conical surface 16 concentric with a longitudinal axis of the cylindrical member 14. By means of the conical surface 16, the head of a centerfire cartridge brought into engagement with the centering means 12 is positioned with an unstruck primer received in a primer pocket thereof disposed in alignment with the central longitudinal axis of the body 11. While it will be appreciated that the principal plane of the face of the cartridge head may not be precisely perpendicular to such a predetermined axis, the use of two hands in guiding the cylindrical member 14 and a shell 10 (as illustrated in FIG. 1) aids and facilitates substantial perpendicularity.

Figure 3:
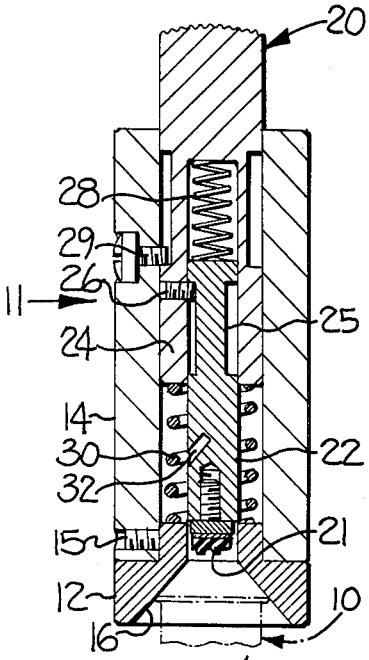
FIG. 3 is an elevation view, partially in section and partially in phantom lines, illustrating the apparatus of FIGS. 1 and 2 in one position of use.
Figure 4:
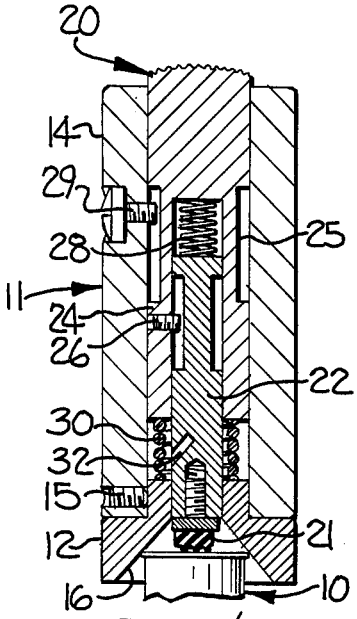
FIG. 4 is a view similar to FIG. 3, illustrating another position of use.
Figure 5:
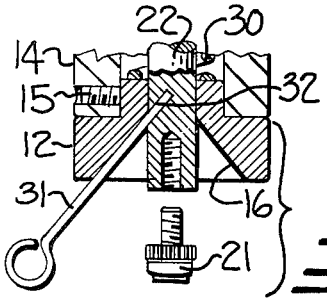
FIG. 5 is a partial elevation view, somewhat similar to FIGS. 3 and 4, illustrating the changing of indicia to be imprinted in accordance with the present invention.

Mounted for movement relative to the body means 11 and along the axis is a plunger means generally indicated at 20. The plunger means bears an indicia element 21 and functions for imprinting indicia onto an unstruck primer of a cartridge received by the body means 11. As visible in FIG. 2, the indicia borne by the element 21 may be any alphanumeric character, such as a numeral or letter or combination of numerals and letters. Preferably, the indicia element is faced with an elastomeric material such as is conventionially used for rubber stamps and the like and is threadingly received in an indicia bearing plunger 22. The indicia bearing plunger 22 is telescopically received within an actuating plunger 24 and is provided with a reduced diameter portion 25 which cooperates with a set screw 26 penetrating the actuating plunger means 24 to capture the indicia bearing plunger means 22 against withdrawal from within the actuating plunger 24. By means a suitable spring 28 or the like, the indicia bearing plunger means 22 is biased toward an extended position relative to the actuating plunger 24 (FIG. 3).

The actuating plunger 24 is similarly captured within the cylindrical member 14 by a lock screw 29 and is biased toward a retracted position (FIG. 3) by an appropriate spring 30.

In use, ink of a desired coloration is supplied in or applied to the indicia element 21. Thereafter, the head of a centerfire firearm cartridge to be imprinted is positioned for imprinting (as indicated by phantom lines in FIG. 3 and by full lines in FIGS. 1 and 4). The plunger means 20 is then depressed manually relative to the body means 11 (FIGS. 1 and 4), compressing the spring 30 which normally maintains the plunger means in retracted position. Thereupon, a force determined by the spring 28 which couples the indicia bearing plunger means 22 and the actuating plunger means 24 urges the indicia element 21 into engagement with an unstuck primer, applying an indicia of the selected coloration and alphanumeric character.

Figure 6:
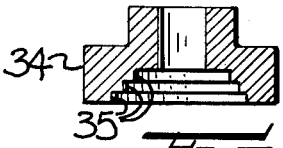
FIG. 6 is an elevation view, in section, showing an alternate form of a centering element used in the apparatus of this invention.

When it is desired to change the coloration and/or alphanumeric character applied, the indicia bearing plunger means is extended in the absence of in a cartridge (FIG. 5) and a locking pin 31 is inserted into a suitable angled bore 32 formed in the indicia bearing plunger 22. The threaded engagement of the indicia element 21 therewith may then be undone, to permit substitution of another selected indicia element.

Where desired, the centering means 12 having a conical surface 16 may be replaced by an alternate centering means 34 (FIG. 6) having a stepped series of circular recesses 35 of progressively decreasing diameters. Each of the recesses is concentric with the axis of the apparatus and is sized to receive a corresponding head diameter. By way of example, a stepped series of circular recesses may be sized to receive the heads of shot shell cartridges in the series of sizes including 10 gauge, 12 gauge, 16 gauge, 20 gauge and 28 gauge. Such an apparatus would permit a sportman engaging in competitive shotgun target games such as trap or skeet to apply indicia identifying load characteristics of cartridges to a series of selected cartridge sizes.

In use in the form illustrated, a centerfire firearm cartridge which has been loaded by a process including insertion of an unstruck primer is positioned and has indicia identifying the load characteristics of the loaded cartridge imprinted onto the unstruck primer. In instances where the cartridge is subsequently reloaded, the removal of the struck primer and insertion of an unstruck primer removes from the centerfire firearm cartridge those indicia which identified the load characteristics of the prior load and permits imprinting onto the unstruck primer indicia coded for identifying the load characteristics of the cartridge after reloading.

While described hereinabove with particular reference to an apparatus and process performed as a step subsequent to the loading or reloading of a cartridge, it is contemplated that the method and apparatus of this invention may be adapted to and incorporated in processes for reloading in such a manner as to apply indicia concurrently with some other reloading steps such as bullet seating or crimping.

In the drawings and specification, there has been set forth a preferred embodiment of the invention, and although specific terms are employed, they are used in a generic and descriptive sense only and not for purposes of limitation.

That which is claimed is:

1. A method of loading a centerfire firearm cartridge while identifying the load characteristics thereof comprising inserting an unstruck primer into a primer pocket in the cartridge head, and thereafter imprinting onto the unstruck primer indicia identifying the load characteristics of the loaded cartridge.

2. A method according to claim 1 wherein the imprinting of indicia comprises applying a distinctive coloration for identifying characteristics of the loaded cartridge.

3. A method according to claim 1 wherein the imprinting of indicia comprises applying a distinctive alphanumeric character for identifying characteristics of the loaded cartridge.

4. A method according to claim 1 wherein the imprinting is preceded by reloading a previously fired cartridge by a process including removing a struck primer from the primer pocket in the cartridge head.

5. A method of reloading a previously fired centerfire firearm cartridge while identifying the load characteristics thereof comprising removing a struck primer from a primer pocket in the cartridge head, thereafter inserting an unstruck primer into the primer pocket, and thereafter imprinting onto the unstruck primer indicia coded for identifying the load characteristics of the reloaded cartridge.

6. A method according to claim 5 wherein the imprinting of indicia comprises applying a single alphanumeric character of distinctive coloration for identifying the characteristics of the reloaded cartridge.

* * * * *